United States Patent [19]

Masuda et al.

[11] 4,009,039

[45] Feb. 22, 1977

[54] HEAT DEVELOPABLE LIGHT-SENSITIVE OXAZOLINE CONTAINING ELEMENT

[75] Inventors: Takao Masuda; Nobuyoshi Sekikawa, both of Asaka, Japan

[73] Assignee: Fuji Photo Film Co., Ltd., Minami-ashigara, Japan

[22] Filed: Aug. 18, 1975

[21] Appl. No.: 605,700

[30] Foreign Application Priority Data

Aug. 19, 1974 Japan ..... 49-94847

[52] U.S. Cl. ..... 96/114.1; 96/109

[51] Int. Cl.[2] ..... G03C 1/02; G03C 1/34

[58] Field of Search ..... 96/114.1, 109, 101, 96/66 R, 76 R, 56.4, 95

[56] References Cited

UNITED STATES PATENTS

| | | | |
|---|---|---|---|
| 3,849,164 | 11/1974 | Schaub et al. | 96/56.4 |
| 3,923,574 | 12/1975 | Haase | 96/101 |

*Primary Examiner*—David Klein

*Assistant Examiner*—Louis Falasco

*Attorney, Agent, or Firm*—Sughrue, Rothwell, Mion, Zinn & Macpeak

[57] ABSTRACT

A heat developable light-sensitive element having reduced thermal fogging and improved light stability comprising a support having therein or in one or more layers thereon (a) an organic silver salt, (b) a light-sensitive silver halide or a compound capable of forming a light-sensitive silver halide upon reaction with the organic silver salt, (c) a reducing agent, and (d) an oxazolinone compound.

6 Claims, No Drawings

HEAT DEVELOPABLE LIGHT-SENSITIVE OXAZOLINE CONTAINING ELEMENT

BACKGROUND OF THE INVENTION

1. Field of the Invention

The present invention relates to a heat-developable light-sensitive element and more particularly to a heat-developable light-sensitive element having reduced thermal fogging (or undesired darkening in the unexposed areas generated during thermal development) and having improved light stability after development.

2. Description of the Prior Art

The most widely used photographic process is a process in which silver halides are employed since such a photographic process has superior photographic properties such as sensitivity and gradation to other photographic processes such as an electrophotographic process and a diazo process. There are, however, disadvantages in the silver halide photographic process. For example, the silver halide light-sensitive element must be developed in an aqueous developing solution after exposure and the thus developed light-sensitive element must be further subjected to several aqueous solution processings such as stopping, fixing and stabilization in order to prevent the thus-formed image from discoloring or fading and to prevent the undeveloped white areas in the image (background) from darkening. These solution processings are time-consuming and troublesome, and the chemicals employed in these processings are hazardous in handling and stain the worker's body and clothes and the processing room. The chemicals may also produce water pollution if the solutions are discharged without treatment.

Therefore, a light-sensitive element which utilizes high speed silver halides which can be processed in a dry manner without using processing solutions and which can be moveover capable of forming a stable image with minimized discoloration in the background areas thereof under normal room illumination has been desired.

To invent such elements various efforts have been made. For example, German Pat. Nos. 1,123,203 and 1,174,157 disclose that heat development of a silver halide light-sensitive element is possible by incorporating therein a 3-pyrazolidone-type developing agent. German Pat. No. 1,175,075 discloses that the heat-developability of the element can be promoted by incorporating therein a material capable of forming water, and German Pat. No. 1,003,578 discloses the additional incorporation therein of a fixing agent for the silver halide. According to the abovedescribed techniques, however, the silver halide itself remaining in the element after the dry processing would never be completely stabilized against light by a dry process, that is, the former three patents do not describe a dry fixing step, and in the light-sensitive element described in the last patent it can be easily appreciated that the copresence of a developing agent (a reductant) and a fixing agent during storage would give rise to an undesirable reaction which would make the element not very practical.

At present the most successful light-sensitive element capable of forming a photographic image by a dry processing method is a heat-developable light-sensitive element employing a composition comprising a silver salt of an organic acid, a small amount of a light-sensitive silver halide and a reducing agent, e.g., as described in U.S. Pat. Nos. 3,152,904 and 3,457,075. In this light-sensitive system the silver halide, which remains in the element after development, is not stabilized against light and is allowed to be discolored by light. Nevertheless the element provides results as if it were stabilized because the silver halide is used in a slight amount and most of the silver source is a white or light-colored organic silver salt which is stable and hardly blackened by light. Thus, even if a small amount of silver halide is discolored by light, the slight discoloring does not give rise to any difficulties visually since the element, on the whole, still appears white or only slightly colored. The light-sensitive element is stable at normal temperature, but when it is image-wise exposed and heated to a temperature, usually, above about 80° C, preferably above 100° C, the organic silver salt oxidizing agent and the reducing agent which are present in the light-sensitive element undergo oxidation-reduction reactions due to the catalytic action of the exposed silver halide present in the vicinity thereof to form silver. By this reaction, the exposed areas of the light-sensitive layer are rapidly blackened so that a contrast is formed between the exposed areas and the unexposed areas (background), that is, an image is formed.

In such a heat-developable light-sensitive element, a significant problem remains to be solved in that undesirable darkening in the unexposed or background areas (called heat fogging) tends to be produced upon heat development. This heat fogging relatively reduces the photographic densities in the image areas corresponding to exposed areas. Methods that have been used in order to eliminate this disadvantage include a method employing mercuric ions such as those described in Japanese Pat. Publication No. 11113/72. Mercury compounds are, however, highly poisonous and there is the danger that mercury may be evaporated during heat development. Further, secondary pollution may occur if used paper supports thereof are regenerated.

In spite of extensive attempts for reducing heat fogging, it is still quite difficult to inhibit heat fogging without impairing the photographic properties, which is well known to those skilled in the art. In general, the sensitivity is reduced by the addition of a heat-fogging inhibitor.

SUMMARY OF THE INVENTION

Therefore, an object of the present invention is to provide a heat-developable light-sensitive element having an extremely low thermal fogging in the background areas.

A second object of the invention is to provide a heat developable light-sensitive element having improved light stability after thermal development.

Other objects of the invention will be apparent from the following description.

It has now been unexpectedly found that these and other objects of the invention are accomplished by a heat-developable light-sensitive element comprising a support having therein or in one or more layers thereon (a) an organic silver salt, (b) a light-sensitive silver halide or a compound capable of forming a light-sensitive silver halide upon reaction with the organic silver salt, (c) a reducing agent, and (d) an oxazolinone compound.

DETAILED DESCRIPTION OF THE INVENTION

The above component (d), which is a most characteristic component in the element of the invention, can be one of the oxazolinone compounds represented by the following general formula (I):

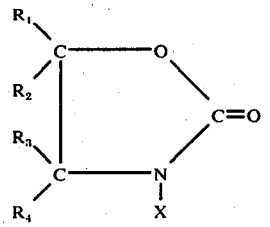

(I)

wherein $R_1$, $R_2$, $R_3$ and $R_4$ each is a hydrogen atom; an alkyl group having 1 to 22 carbon atoms (e.g., methyl, ethyl, isopropyl, propyl, n-butyl, isobutyl, t-butyl, isoamyl, octyl, decyl, dodecyl, tetradecyl, hexadecyl, etc., groups); a haloalkyl group having 1 to 22 carbon atoms (e.g., trichloromethyl, chloromethyl, 2-chloroethyl, 4-chlorobutyl, etc., groups); an amino group (e.g., amino, dimethylamino, diethylamino, di(chloroethyl-)amino, etc., groups); a hydroxyalkyl group having 1 to 22 carbon atoms (e.g., hydroxymethyl, hydroxyethyl, 3-hydroxypropyl, 4-hydroxybutyl, etc., groups); an allyl group; a naphthyl group; a benzyl group;

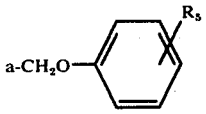

group in which $R_5$ is a hydrogen atom, a halogen atom (e.g., fluorine, chlorine, bromine, etc., atoms), an alkyl group (e.g., having 1 to 4 carbon atoms such as methyl, ethyl, propyl, isopropyl, n-butyl, t-butyl isobutyl, etc., groups), an alkylthio group (e.g., methylthio, ethylthio, butylthio, dodecylthio, etc., groups), an amino group or an alkyl-substituted amino group (e.g., dimethylamino, diethylamino, di-n-butylamino, di-t-butylamino, etc., groups); a benzyloxy group; an aryl group (e.g., phenyl, $\alpha$-naphthyl, $\beta$-naphthyl, etc., groups); a haloaryl group (e.g., halophenyl groups in which the halogen atom is a fluorine, chlorine or iodine atoms); an alkylaryl group (e.g., alkylaryl groups in which the alkyl moiety contains 1 to 4 carbon atoms such as methyl, ethyl, propyl, iso-propyl, n-butyl, iso-butyl, t-butyl, etc., moieties); an alkoxyaryl group (e.g., alkoxyaryl groups in which the alkoxy moiety contains 1 to 4 carbon atoms such as methoxy, ethoxy, propoxy, iso-propoxy, n-butoxy, isobutoxy, t-butoxy, etc., moieties); an $-OR_6$ group in which $R_6$ is a hydrogen atom, an alkyl group (e.g., methyl, ethyl, n-propyl, iso-propyl, n-butyl, t-butyl, etc., groups), an aryl group (e.g., a phenyl, etc., group), an allyl group or an alkoxyaryl group (e.g., alkoxyaryl groups in which the alkoxy moiety contains 1 to 4 carbon atoms such as methoxy, ethoxy, propoxy, iso-propoxy, n-butoxy, iso-butoxy, t-butoxy, etc., moieties);

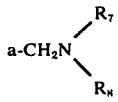

group in which $R_7$ and $R_8$ each is a hydrogen atom, an alkyl group (e.g., methyl, ethyl, n-propyl, iso-propyl, n-butyl, t-butyl, etc., groups), an aryl group (e.g., a phenyl, etc., group) or an allyl group; a cyclohexyl group; a $-CH_2OR_9$ group in which $R_9$ is a naphthyl group; or a $-CH_2R_{10}$ group in which $R_{10}$ is a morpholino group, a piperadino group or an alkylthio group (e.g., methylthio, ethylthio, butylthio, dodecylthio, etc., groups); and X is a hydrogen atom, a chlorine atom or a bromine atom.

Examples of compounds represented by the above general formula include 2-oxazolinone, N-bromo-2-oxazolinone, N-chloro2-oxazolinone, 4-amino-2-oxazolinone, 4-amino-N-chloro-2-oxazolinone, 4-amino-N-bromo-2-oxazolinone, 4-amino-5-methyl-2-oxazolinone, 4-amino-5-methyl-N-bromo(or N-chloro)-2-oxazolinone, 5-[(p-aminophenoxy)methyl]-N-bromo(or N-chloro)-2-oxazolinone, 5-[(p-aminophenoxy)methyl]-2-oxazolinone, 4-benzyl-N-bromo( or N-chloro)-2-oxazolinone, 4-benzyl-2-oxazolinone, 4-benzyloxy-2-oxazolinone, 4-benzyloxy-N-bromo( or N-chloro)-2-oxazolinone, 4-methyl-N-bromo(or N-chloro)-2-oxazolinone, 4-methyl-2-oxazolinone, 5-methyl-2-oxazolinone, 5-methyl-N-bromo(or N-chloro)-2-oxazolinone, 5-[(p-bromophenoxy)methyl]-2-oxazolinone, 5-[(p-bromophenoxy)methyl]-N-bromo(or N-chloro)-2-oxazolinone, 5-butyl-2-oxazolinone, 5-t-butyl-5-methyl-2-oxazolinone, 5-butyl-N-bromo(or N-chloro)-2-oxazolinone, 5-t-butyl-5-methyl-N-bromo(or N-chloro)-2-oxazolinone, 5-t-butyl-4-phenyl-2-oxazolinone, 5-t-butyl-4-phenyl-N-bromo(or N-chloro)-2-oxazolinone, 5-phenyl-2-oxazolinone, 5-cyclohexyl-4-ethyl-2-oxazolinone, 5-phenyl-N-bromo(or N-chloro)-2-oxazolinone, 5-cyclohexyl-4-ethyl-N-bromo(or N-chloro)-2-oxazolinone, 4decyl2-oxazolinone, 4-decyl-N-bromo(or N-chloro)-2-oxazolinone, 4,5-diethyl-N-bromo(or N-chloro)-2-oxazolinone, 4,5-diethyl-2-oxazolinone, 4,4-diethyl-2-oxazolinone, 4,4-dimethyl-N-bromo(or N-chloro)-2-oxazolinone, 4-[(dimethylamino)methyl]-5-methyl-2-oxazolinone, 4-[(dimethylamino)methyl]-methyl-N-bromo(or N-chloro)-2-oxazolinone, 4,5-dioctyl-2-oxazolinone, 4,4-diphenyl-2-oxazolinone, 4,5-dioctyl-N-bromo(or N-chloro)-2-oxazolinone, 4,4-diphenyl-N-bromo(or N-chloro)-2-oxazolinone, 4,5-diphenyl-N-bromo(or N-chloro)-2-oxazolinone, 5-fluoren-9-ylidene-4-methyl-2-oxazolinone, 5-fluoren-9-ylidene-4-methyl-N-bromo(or N-chloro)-2-oxazolinone, 5-(2-furyl)-2-oxazolinone, 5-(2-furyl)-N-bromo(or N-chloro)-2-oxazolinone, 4-methyl-5-(2-naphthyl)-2-oxazolinone, 4-methyl-5-(2-naphthyl)-N-bromo(or N-chloro)-2-oxazolinone, 5-(2-thienyl)-N-bromo(or N-chloro)-2-oxazolinone and 5-(2-thienyl)-2-oxazolinone.

All of these compounds are known and can be readily prepared by reference to, for example, *Chemical Abstracts*, Coll. Vol. 55–56, p. 16,081s and ibid, Coll. Vol. 67–71, p. 22,017.

Further, compounds of the general formula (I) can be easily produced from 2-oxazolidinone, which is well known, by bromination to produce the compounds of the general formula (I), e.g., as disclosed in Kenichi Morita, *Bull. Chem. Soc. Japan.*, 31 347-351 (1958).

Regardless of how the effect of the component (d) of the invention is exerted, it is very surprising that the incorporation of component (d) leads to a reduction in thermal fogging and an increase in light stability after thermal development of the heatdevelopable light-sensitive element.

The organic silver salts employed as component (a) in the invention are colorless, white or slightly colored silver salts which are comparatively stable to light and which react with the reducing agents to form silver images when heated to a temperature of about 80° C or higher, preferably 100° C or higher, in the presence of an exposed silver halide. Examples of organic silver salts include silver salts of organic compounds containing an imino group, a mercapto group, a thione group or a carboxyl group. Typical examples of these organic silver salts include:

1. SILVER SALTS OF ORGANIC COMPOUNDS CONTAINING AN IMINO GROUP:

Silver benzotriazole, silver nitrobenzotriazole, silver alkyl-substituted benzotriazoles (e.g., silver methylbenzotriazole), silver halogen-substituted benzotriazoles (e.g., silver bromobenzotriazole or silver chlorobenzotriazole), silver carboimide-substituted benzotriazoles (e.g.,

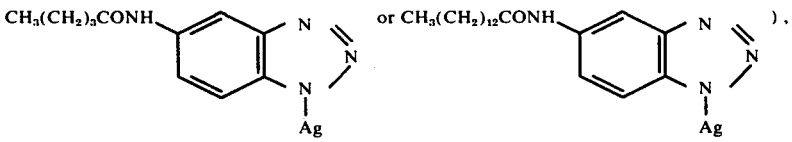

silver benzoimidazole, silver substituted-benzimidazoles (e.g., silver 5-chlorobenzimidazole or silver 5-nitrobenzimidazole), silver carbazole, silver saccharin, silver phthalazinone, silver substituted-phthalazinone, silver salts of phthalimides, silver pyrrolidone, silver tetrazole and silver imidazole;

2. SILVER SALTS OF ORGANIC COMPOUNDS CONTAINING A MERCAPTO GROUP OR A THIONE GROUP:

Silver 3-mercapto-4-phenyl-1,2,4-triazole, silver 2-mercaptobenzimidazole, silver 2-mercapto-5-aminothiadiazole, silver 1-phenyl-5-mercaptotetrazole, silver 2-mercaptobenzothiazole, silver salts of the thioglycolic acids as described in Japanese Patent Application (OPI) 28221/73 (e.g., silver 2-(S-ethylenethioglycolamido)benzthiazole or silver S-alkyl-($C_{12}$ – $C_{22}$)thioglycolates), silver salts of dithiocarboxylic acids (e.g., silver dithioacetate), silver thioamide, silver salts of thiopyridines (e.g., silver 5-carbethoxy-1-methyl-2-phenyl-4-thiopyridine), silver dithiohydroxybenzole, silver mercaptotriazine, silver 2-mercaptobenzoxazole and slver mercaptotriazine, etc.;

3. SILVER SALTS OF ORGANIC COMPOUNDS CONTAINING A CARBOXYLIC GROUP:

a. Silver salts of aliphatic carboxylic acids:

Silver caprate, silver laurate, silver myristate, silver palmitate, silver stearate, silver behenate, silver maleate, silver fumarate, silver tartarate, silver furoate, silver linolate, silver oleate, silver hydroxystearate, silver adipate, silver sebacate, silver succinate, silver acetate, silver butyrate and silver camphorate;

b. Silver aromatic carboxylates and the others:

Silver benzoate, slver 3,5-dihydroxybenzoate, silver o-methylbenzoate, silver m-methylbenzoate, silver p-methylbenzoate, silver 2,4-dichlorobenzoate, silver acetamidobenzoate, silver p-phenylbenzoate, silver salts of other substituted benzoic acids, silver gallate, silver tannate, silver phthalate, silver terephthalate, silver salicylate, silver phenylacetate, silver pyrometllitate, silver 4'-n-octadecyloxydiphenyl-4-carboxylate, silver thionecarboxylates as disclosed in U.S. Pat. No. 3,785,830 and silver salts of aliphatic carboxylic acids containing a thioether group as disclosed in U.S. Pat. No. 3,330,663;

4. OTHER SILVER SALTS:

Silver 4-hydroxy-6-methyl-1,3,3*a*,7-tetraazaindene, silver 5-methyl-7-hydroxy-1,2,3,4,6-pentaazindene, silver tetraazindene as disclosed in British Pat. No. 1,230,642, silver S-2-aminophenylthiosulfate as disclosed in U.S. Pat. No. 3,549,379, metal-containing aminoalcohols as disclosed in Japanese Patent Application (OPI) 6586/71, and organic acid-metal chelates as disclosed in Belgian Pat. No. 768,411.

An oxidizing agent such as titanium dioxide, zinc oxide or gold carboxylates (e.g., aurous laurate, aurous stearate or aurous behenate) other than silver salts can be employed together with the organic silver salt, if desired.

Various processes are known for preparing such organic silver salts. One of the simplest processes for preparing them is described in U.S. Pat. No. 3,457,075 wherein a solution of an organic silver salt forming agent or a salt thereof in a watermiscible solvent, such as an alcohol or acetone, or water is mixed with an aqueous solution of a water-soluble silver salt such as silver nitrate to prepare an organic silver salt.

Further, it is possible to use the process described in U.S. Pat. No. 3,839,049 wherein a colloidal dispersion of an ammonium salt or an alkali metal salt of an organic silver salt forming agent is mixed with an aqueous solution of a watersoluble silver salt such as silver nitrate. In a similar process, it is possible to use an aqueous solution of a silver complex salt such as a silver amine complex salt or a solution of such a salt in a water-miscible solvent instead of the aqueous solution of the water-soluble silver salt such as silver nitrate.

Another process for preparing organic silver salts is the process described in U.S. Pat. No. 3,458,544. Namely, in this process, organic carboxylic acid silver salts are prepared by mixing a solution (oily solution) which is difficult to dissolve in water such as a benzene solution of an organic carboxylic acid with an aqueous solution of a silver complex salt. Preferably the water is added to the oily solution to form an emulsion prior to mixing with the aqueous solution of the silver complex salt. This process can be also applied to the preparation of other organic silver salts.

A similar process has been described in Canadian Pat. No. 847,351 wherein the resulting organic silver salts are more stable to heat and light. In this process, a silver salt solution without using an alkali such as an aqueous solution containing only silver nitrate is used instead of the silver complex salt.

Further, a process for preparing organic silver salts is described in West German Pat. application (OLS) 2,402,906. This process is preferred because heat-developable light-sensitive materials containing the resulting organic silver salt do not form as much heat-fog (undesirable fog generated on the unexposed area when the light-sensitive material is heated). Namely, this process comprises mixing an emulsion composed of an aqueous solution of a salt (for example, an alkali metal salt such as a sodium salt, a potassium salt or a lithium salt or an ammonium salt, etc.) of a water-soluble organic silver salt forming agent and an oil (for example, benzene, toluene, cyclohexane, pentane, hexane, carboxylic acid esters such as an acetate, phosphoric acid esters, and oils such as castor oil, etc.) with a solution of, and preferably an aqueous solution of, a silver salt which is more water-soluble than the organic silver salt (such as silver nitrate) or a silver complex salt to prepare the organic silver salt. In another embodiment of this process, it is possible to prepare the organic silver salt by mixing an aqueous alkali solution (for example, an aqueous solution of sodium hydroxide) with an oil-soluble solution of an organic silver salt forming agent (for example, a toluene solution of the organic silver salt forming agent) and mixing the resulting emulsion with a solution, and preferably an aqueous solution, of a soluble silver salt such as silver nitrate or a silver complex salt such as a silver ammine complex salt.

The oils which can be used for the above-described oily solution include the following compounds:

1. Phosphoric acid esters:

For example, tricresyl phosphate, tributyl phosphate, and monooctyl dibutyl phosphate, etc.

2. Phthalic acid esters:

For example, diethyl phthalate, dibutyl phthalate, dimethyl phthalate, dioctyl phthalate and dimethoxyethyl phthalate, etc.;

3. Carboxylic acid esters:

For example, acetates such as amyl acetate, isopropyl acetate, isoamyl acetate, ethyl acetate, 2-ethylbutyl acetate, butyl acetate and propyl acetate, etc.; sebacates such as dioctyl sebacate, dibutyl sebacate, and diethyl sebacate, etc.; succinates such as diethyl succinate; formates such as ethyl formate, propyl formate, butyl formate and amyl formate, etc.; tartarates such as diethyl tartarate; valerates such as ethyl valerate; butyrates such as methyl butyrate, ethyl butyrate, butyl butyrate and isoamyl butyrate; and adipic acid esters, etc.;

4. Oils such as castor oil, cotton seed oil, linseed oil and tsubaki oil, etc.;

5. Aromatic hydrocarbons such as benzene, toluene and xylene, etc.;

6. Aliphatic hydrocarbons such as pentane, hexane and heptane, etc.; and

7. Cyclic hydrocarbons such as cyclohexane.

Examples of silver complex salts include silver ammine complex salt, silver methylamine complex salt and silver ethylamine complex salt, and preferably alkali-soluble complex salts having a dissociation constant higher than the organic silver salts are suitably used.

Examples of solvents for the silver salts such as silver nitrate include not only water but also polar solvents such as dimethyl sulfoxide, dimethylformamide and acetonitrile, etc.

Further, ultrasonic waves can be employed during the preparation of the organic silver salts as described in West German Pat. application (OLS) No. 2,401,159. Particularly, emulsification can be easily carried out by applying ultrasonic waves when it is desired to emulsify water and oils. Further, it is possible to use surface active agents for the purpose of controlling the particle size of the organic silver salts during the preparation thereof.

The organic silver salts can also be prepared in the presence of polymers. A specific process has been described in U.S. Pat. No. 3,700,458, which comprises mixing a non-aqueous solution of an organic carboxylic acid with a non-aqueous solution of a heavy metal salt of trifluoroacetate or tetrafluoroborate in the presence of a polymer to produce a heavy metal salt of the organic carboxylic acid such as a silver salt thereof. A process which comprises reacting a colloid dispersion of an organic silver salt forming agent with an aqueous solution of silver nitrate has been described in U.S. Pat. No 3,839,049. Furthermore, a process for producing an emulsion using similar non-aqueous solutions has been described in U.S. Pat. No. 3,748,143. In addition, it is possible, as described in Japanese Pat. application (OPI) No. 13224/1974, West German Pat. application (OLS) No. 2,322,096, to change the particle form, the particle size and photographic properties such as light stability or sensitivity of the organic silver salts due to the presence of a metal salt or a metal complex such as a mercury or lead compound during the preparation of the organic silver salts.

It has been also confirmed that cobalt, manganese, nickel, iron, rhodium, iridium, platinum, gold, cadmium, zinc, lithium, copper, thallium, tin, bismuth, antimony, chromium, ruthenium, palladium and osmium in addition to the mercury and lead described above are effective as the metal. In order to use these metal containing compounds, a mixture or dispersion of a solution of a silver salt forming orgaic compound and a metal containing compound can be mixed with an aqueous solution of a soluble silver salt such as silver nitrate or an aqueous solution of a silver complex salt such as a silver ammine complex salt. Further, a solution or dispersion of the metal containing compound can be mixed with an aqueous solution of the silver salt or a silver complex salt and a solution or dispersion of the silver salt forming organic compound. Furthermore, a method comprising mixing a solution or dispersion of the silver salt forming organic compound with a solution or dispersion of a mixture of the silver salt or silver complex salt and the metal containing compound is also preferred. A preferred amount of the metal containing compound ranges from about $10^{-6}$ to $10^{-1}$ mols per mol of the organic silver salt and from about $10^{-5}$ to $10^{-2}$ mols per mol of the silver halide.

The particle size of thus-resulting organic silver salts is about 0.01 micron to about 10 microns as the longer diameter and preferably about 0.1 micron to about 5 microns.

Exmaples of light-sensitive silver halides which can be employed as component (b) in the invention include silver chloride, silver bromide, silver iodide, silver chlorobromoiodide, silver chlorobromide, silver chloroiodide, silver iodobromide and a mixture thereof. The light-sensitive silver halide can be coarse particles or fine particles, but preferably is fine particles. A preferred particle size of the silver halide is about 0.001 to 1 micron, more preferably about 0.01 to 0.5 micron, in the longer diameter.

The light-sensitive silver halide can be prepared by any of the procedures known in the field of photography, such as a single jet procedure and a double jet procedure. Examples of silver halides used in the invention include these prepared by a Lippmann process, an ammoniacal process and thiocyanate or thioether ripening process. The silver halide used can be unwashed or washed, e.g., with water, alcohols, etc., to remove soluble salts.

The silver halide used in the invention can be chemically sensitized with a chemical sensitizer such as sulfur, selenium, tellurium, gold, platinum, palladium, a stannous halide, etc, e.g., as disclosed in U.S. Pat. Nos. 1,623,499, 2,399,083 and 3,297,447. The silver halide preferably contains an antifoggant or a stabilizer such as a thiazolium salt, an azaindene, a mercury salt, a urazole, a sulfocatecol, an oxime, a nitron, a nitroindazole, etc., to stabilize the silver halide to fog, e.g., as disclosed in U.S. Pat. Nos. 2,728,663, 2,839,405, 2,566,263, 2,597,915 and British Pat. No. 623,448.

The silver halide emulsion prepared in advance can be mixed with an oxidation-reduction composition comprising an organic silver salt and a reducing agent, as described in U.S. Pat. No. 3,152,904. According to this method, however, sufficient contact is not attained between the silver halide and the organic silver salt (e.g., as disclosed in U.S. Pat. No. 3,457,075). In order to achieve good contact between the silver halide and the organic silver salt, various techniques can be employed. One effective technique is to mix the materials in the presence of a surface active agent, as described in Japanese Pat. application Nos. 82852/73 and 82851/73. According to another method a silver halide is prepared in the presence of a polymer and then mixed with an organic silver salt (for example, as disclosed in U.S. Pat. Nos. 3,705,565; 3,713,833; 3,706,564 and 3,761,273; French Pat. Nos. 2,107,162 and 2,078,586; and Belgain Pat. No. 774,436.

The light-sensitive silver halide employed in the invention can be simultaneously prepared with the preparation of the organic silver salt as disclosed in Japanese Pat. application No. 65727/73. That is, the silver halide can be prepared by mixing a silver salt (e.g., silver nitrate or a silver complex salt) solution with a solution or dispersion of an organic silver saltforming compound or a salt thereof and a silver halide-forming compound solution, or by mixing a silver halide-forming compound solution and a solution or dispersion of an organic silver salt-forming compound or a salt thereof and a solution of a silver salt such as silver nitrate or a silver complex salt, whereby silver halide is prepared simultaneously with the organic silver salt. Further, the light-sensitive silver halide employed in the invention can be prepared by a partial conversion of the organic silver salt by subjecting a solution or dispersion of the previously prepared organic silver salt to a silver halide forming compound or a sheet material containing an organic silver salt with a silver halide forming compound. The thus-prepared silver halide is effectively contacted with the organic silver salt to provide preferred results as disclosed in U.S. Pat. No. 3,457,075.

The light-sensitive silver halide-forming components which can be employed in this invention include any compounds capable of forming silver halide on reaction with the organic silver salt. Whether the compounds can be employed as a silver halide-forming component can be determined by a routine test. For example, after mixing a compound for forming a silver halide with the organic silver salt, and if necessary heating, the X-ray diffraction pattern obtained by an X-ray diffraction method is examined to determine whether diffraction peaks inherent to silver halide are present.

Examples of silver halide forming components include the following compounds.

1. Inorganic halides:

For example, halides represented by the formula $MX'_n$, wherein M represents H, $NH_4$ or a metal atom, X' represents Cl, Br or I, and n is 1 if M represents H or $NH_4$, or n represents the valence of the metal atom if M represents a metal atom. Examples of suitable metal atoms include lithium, sodium, potassium, rubidium, cesium, copper, gold, beryllium, magnesium, calcium, strontium, barium, zinc, cadmium, mercury, aluminium, gallium, indium, thallium, germanium, tin, lead, antimony, bismuth, chromium, molybdenum, tungsten, manganese, rhenium, iron, cobalt, nickel, ruthenium, rhodium, palladium, osmium, iridium and platinum.

2. Halogen containing metal complexes:

For example, $K_2PtCl_6$, $K_2PtBr_6$, $HAuCl_4$, $(NH_4)_2IrCl_6$, $(NH_4)_3IrCl_6$, $(NH_4)_2RuCl_6$, $(NH_4)_3RuCl_6$, $(NH_4)_3RhCl_6$ and $(NH_4)_3RhBr_6$, etc.

3. Onium halides:

For example, quaternary ammonium halides such as trimethylphenyl ammonium bromide, cetylethyldimethyl ammonium bromide and trimethylbenzyl ammonium bromide, quaternary phosphonium halides such as tetraethyl phosphonium bromide and tertiary sulfonium halides such as trimethyl sulfonium iodide. Further, these onium halides can be used in final coating dispersions for the purpose of decreasing sensitivity or, if desired, decreasing the background density, as described in U.S. Pat. No. 3,679,422.

4. Halogenated hydrocarbons:

For example, iodoform, bromoform, carbon tetrabromide and 2-bromo-2-methylpropane, etc.

5. N-halogen compounds:

For example, compounds represented by the following formulae:

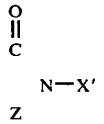

(II)

and

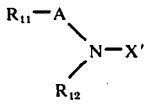

(III)

wherein X' represents Cl, Br or I; Z represents a group of atoms necessary to form a 5— or 6—membered ring, wherein the 5— or 6-membered ring may be condensed with another ring; A represents a carbonyl group or a sulfonyl group; and $R_{11}$ and $R_{12}$ each represents an alkyl group, an aryl group or an alkoxy group. For example, N-bromosuccinimide, N-bromophthalimide, N-bromoacetamide, N-iodosuccinimide and N-bromophthaladinone, etc., are suitable. These compounds have been described in detail in West German Pat. application (OLS) No. 2,453,131. In addition, N-halo compounds of benzotriazole and substituted benzotriazoles such as the alkyl, nitro, halo, imido or amino substituted benzotriazoles are also effective. Furthermore, N-bromobenzimidazoles are suitable.

6. Other halogen containing compounds:

For example, triphenylmethyl chloride, triphenylmethyl bromide, 2-bromobutyric acid, 2-bromoethanol and dichlorobenzophenone, etc.

In the above-described processes and the process of the present invention, the improvement of photographic properties, such as increase of sensitivity and elimination of heat-fog, etc., can be achieved by ripening by allowing the composition to stand at room temperature (about 20° – 25° C) to a higher temperature (30° C – 80° C) for a suitable time (for example, 20 minutes to 48 hours) after addition of the silver halide-forming component.

The silver halide-forming compound can be employed individually or as a combination thereof. A suitable amount of the silver halide forming component is about 0.001 to 0.5 mol, preferably about 0.01 to 0.3 mol, per mol of the organic silver salt employed as the component (a). If the amount is more than about 0.5 mol, the color changes which is an undesirable coloration of the background which occurs on allowing the exposed and developed light-sensitive material to stand under normal room illumination. If the amount is less than about 0.001, the sensitivity is reduced.

The reducing agent of component (c) used in the heat-developable light-sensitive materials of the present invention is a compound capable of reducing the organic silver salt component (a) when heated in the presence of an exposed silver halide and can be suitably selected depending upon the organic silver salt component (a) with which it is used in combination. Examples of such reducing agents include substituted phenols, substituted or unsubstituted bisphenols, substituted or unsubstituted mono- or bisnaphthols, di- or polyhydroxybenzenes, di- or polyhydroxynaphthalenes, hydroquinone monoethers, ascorbic acid and derivatives thereof, 3-pyrazolidones, pyrazolin-5-ones, reducing saccharides, aromatic primary amino compounds, reductones, kojic acid, hinokitiol, hydroxylamines, hydroxytetronic acids, hydroxytetronic acid amides, hydroxamic acids, sulfhydrooxamic acids, hydrazides, indan-1,3-diones and p-oxyphenylglycines, etc. Of these reducing agents, reducing agents which are photolytically decomposed are preferred. Photolytically decomposable reducing agents are described in U.S. Pat. No. 3,827,889. Further, it is possible to use the reducing agents together with compounds which accelerate the photolysis, as described in U.S. Pat. No. 3,756,829. Blocked bisphenol-type reducing agents are also used as preferred compounds and have been described in, for example, U.S. Pat. No. 3,589,903 and Japanese Pat. applications Nos. 81625/1973 and 22135/1974. Other examples of the reducing agents which can be used in the present invention are described in U.S. Pat. Nos. 3,152,904, 3,457,075, 3,531,286, 3,615,533, 3,679,426, 3,672,904, 3,751,252, 3,751,255, 3,782,949, 3,770,448 and 3,773,512, U.S. Pat. No. 3,819,382 and Belgian Pat. No. 786,086.

Examples of suitable reducing agents are as follows:

1. Substituted phenols:

Aminophenols, for example, 2,4-diaminophenol, methylaminophenol, p-aminophenol, o-aminophenol, 2-methoxy-4-aminophenol and 2-β-hydroxyethyl-4-aminophenol, etc.; alkyl-substituted phenols, for example, p-t-butylphenol, p-t-amylphenol, p-cresol, 2,6-di-t-butyl-p-cresol, p-ethylphenol, p-sec-butylphenol, 2,3-dimethylphenol, 3,4-xylenol, 2,4-xylenol, 2,4-di-t-butylphenol, 2,4,5-trimethylphenol, p-nonylphenol and p-octylphenol, etc.; other phenols, for example, p-acetophenol, p-acetoacetyl-4-methylphenol, 1,4-dimethoxyphenol, 2,6-dimethoxyphenol, chlorothymol, 3,5-di-t-butyl-4-hydroxybenzyl-dimethylamine, and sulfonamidophenols, for example, compounds described in U.S. Pat. No. 3,801,321; and novolak resin type reaction products of formaldehyde and phenol derivatives (for example, 4-methoxyphenol, m-cresol, o- or p-butylphenol, 2,6-di-t-butylphenol and mixtures thereof, etc.);

2. Substituted or unsubstituted bisphenols:

o-bis-Phenols, for example, 1,1-bis-(2-hydroxy-3,5-dimethylphenyl)-3,5-trimethylhexane, bis-(2-hydroxy-3-t-butyl-5-methylphenyl)methane, bis-(2-hydroxy-3,5-di-t-butylphenyl)methane, bis-(2-hydroxy-3-t-butyl-5-ethylphenyl)methane, 2,6-methylenebis-(2-hydroxy-3-t-butyl-5-methylphenyl)-4-methylphenol, 1,1-bis-(5-chloro-2-hydroxyphenyl)methane, 2,2'-methylene-bis- 4-methyl-6-(1-methylcyclohexyl)-phenol , 1,1-bis-(2-hydroxy-3,5-dimethylphenyl)-2-methylpropane, 1,1,5,5-tetrakis-(2-hydroxy-3,5-dimethylphenyl)-2,4-ethylpentane and 3,3',5,5'-tetramethyl-6,6'-dihydroxytriphenylmethane; p-bis-phenols, for example, bisphenol A, 4,4'-methylene-bis-(3-methyl-5-t-butylphenol), 4,4'-methylene-bis-(2,6-di-t-heptylidene)-di-(o-cresol), 4,4'-ethylidene-bis-(2,6-di-tert-butylphenol), 4,4'-(2-butylidene)-di-(2,6-xylenol), 4,4'-(p-methylbenzylidene)-di-(o-cresol), 4,4'-(p-methoxybenzylidene)-bis-(2,6-di-tert-butylphenol), 4,4'-(p-nitrobenzylidene)-di-(2,6-xylenol) and 4,4'-(p-hydroxybenzylidene)-di-(o-cresol); and others, for example, 3,5-di-t-butyl-4-hydroxybenzyl-dimethylamine, polyphenols such as α,α'-(3,5-di-t-butyl-4-hydroxyphenyl)dimethylether, 2,4,6-tris-(3,5-di-t-butyl-4-hydroxybenzyl)phenol, N,N'-di-(4-hydroxyphenyl)urea and tetrakis-[methylene-(3,5-di-t-butyl-4-hydroxyhydrocinnamate]methane, diethylstilbestrol, hexestrol, bis-(3,5-di-t-butyl-4-hydroxybenzyl)ether and 2,6-bis-(2'-hydroxy-3'-t-butyl-5'-hydroxybenzyl)-4-methylphenol, etc.

3. Substituted or unsubstituted mono- or bisnaphthols and di- or polyhydroxynaphthalenes:

bis-β-Naphthols, for example, 2,2'-dihydroxy-1,1'-binaphthyl, 6,6'-dibromo-2,2'-dihydroxy-1,1'-binaphthyl, 6,6'-dinitro-2,2'-dihydroxy-1,1'-binaphthyl, bis-(2-hydroxy-1-naphthyl)methane and 4,4'-dimethoxy-1,1'-dihydroxy-2,2'-binaphthyl; naphthols, for example, α-naphthol, β-naphthol, 1-hydroxy-4-aminonaphthalene, 1,5-dihydroxynaphthalene, 1,3-dihydroxynaphthalene, 1-hydroxy-2-phenyl-4-methoxynaphthalene, 1-hydroxy-2-methyl-4-methoxynaphthalene, 1-hydroxy-4-methoxynaphthalene, 1,4-dihydroxynaphthalene, methylhydroxynaphthalene, sodium 1-amino-2-naphthol-6-sulfonate, 1-naphthylamine-7-sulfonic acid and sulfonamidonaphthols.

4. Di- or polyhydroxybenzenes and hydroxymonoethers (e.g., as described in, for example, U.S. Pat. No. 3,801,321): Hydroquinone; alkyl substituted hydroquinones, for example, methylhydroquinone, t-butylhydroquinone, 2,5-dimethylhydroquinone, 2,6-dimethylhydroquinone and t-octylhydroquinone, etc.; halogensubstituted hydroquinones, for example, chlorohydroquinone, dichlorohydroquinone and bromohydroquinone, etc.; alkoxysubstituted hydroquinone, for example, methoxyhydroquinone and ethoxyhydroquinone, etc.; other substituted hydroquinones, for example, phenylhydroquinone and hydroquinone monosulfonate, etc.; hydroquinone monoethers, for example, p-methoxyphenol, p-ethoxyphenol, hydroquinone monobenzyl ether, 2-t-butyl-4-methoxyphenol, 2,5-di-t-butyl-4-methoxyphenol, hydroquinone mono-n-propyl ether and hydroquinone mono-n-hexyl ether; and others, for example, catechol, pyrogallol, resorcinol, 1-chloro-2,4-dihydroxybenzene, 3,5-di-t-butyl-2,6-dihydroxybenzoic acid, 2,4-dihydroxybenzoic acid, 2,4-dihydroxyphenyl sulfide, methyl gallate, and propyl gallate, etc.

5. Ascorbic acid and derivatives thereof:

l-Ascorbic acid; isoascorbic acid; ascorbic acid monoesters, for example, ascorbic acid monolaurate, monomyristate, monopalmitate, monostearate and monobehenate; ascorbic acid diesters, for example, ascorbic acid dilaurate, dimyristate, dipalmitate and distearate; and the compounds described in U.S. Pat. No. 3,337,342.

6. 3-Pyrazolines and pyrazolones:

For example, 1-phenyl-3-pyrazolidone, 4-methyl-4-hydroxymethyl-1-phenyl-3-pyrazolidone, the compounds described in British Pat. 930,572, and 1-(2-quinolyl)-3-methyl-5-pyrzolone, etc.

7. Reducing saccharides:

For example, glucose and lactose, etc.

8. Aromatic primary amino compounds:

Examples of typical compounds include N,N-diethyl-p-phenylenediamine, 2-amino-5-diethylaminotoluene, 2-amino-5-(N-ethyl-N-laurylamino)toluene, 4-[N-ethyl-N-(β-hydroxyethyl)amino]aniline and 3-methyl-4-amino-N-ethyl-N-(β-hydroxyethyl)aniline, 4-amino-3-methyl-N-ethyl-N-(β-methanesulfoamidoethyl)aniline sesquisulfate monohydrate as described in U.S. Pat. No. 2,193,015, N-(2-amino-5-diethylaminophenylethyl)methanesulfoamide sulfate as described in U.S. Pat. No. 2,592,364, N,N-dimethyl-p-phenylenediamine hydrochloride and 3-methyl-4-amino-N-ethyl-N-methoxyethylaniline as described in Japanese Pat. application (OPI) No. 64933/1973, and the inorganic salts thereof. These compounds have been described in L.F.A. Mason, *Photographic Processing Chemistry*, pages 226 – 229, Focal Press, London (1966).

9. Hydroxylamines:

For example, N,N-di-(2-ethoxyethyl)hydroxylamine, etc.

10. Reductones:

Anhydro-dihydroaminohexose reductones as described in, for example, U.S. Pat. No. 3,679,426, and linear aminoreductones as described in Belgian Pat. No. 786,086.

11. Hydroxamic acids:

For example, hydroxamic acids as described in U.S. pat. Nos. 3,751,252 and 3,751,255.

12. Hydrazides:

For example, hydroxy substituted aliphatic acid aryl hydrazides as described in U.S. Pat. No. 3,782,949.

13. Other compounds:

For example, pyrazoline-5-ones as described in U.S. Pat. No. 3,770,448, indan-1,3-diones having at least one hydrogen atom at the 2-position thereof as described in U.S. Pat. No. 3,773,512; amidoximes as described in U.S. Pat. No. 3,794,488, and reducing agents as described in U.S. Pat. No. 3,615,533 and U.S. Pat. No. 3,819,382.

Of these reducing agents, the compounds having an alkyl group (e.g., a methyl group, an ethyl group, a propyl group, an isopropyl group, a butyl group or an amyl group) on at least one position adjacent to the position at which a hydroxyl group is bonded to an aromatic nucleus are preferred because they are stable to light and color change due to exposure to light is small. For example, mono—, bis—, tris or tetrakis phenols having a 2,6-di-tert-butyl-phenol group are preferred examples of reducing agents. Typical examples of these compounds are (i) esters of carboxylic acids derived from phenols having a bulky substituent in at least one ortho-position with monohydric or polyhydric alcohols or phenols, and (ii) esters of alcohols derived from phenols having a bulky substituent in at least one ortho-position or phenols having a bulky substituent in at least one ortho-position with mono- or polycarboxylic acids. These esters can be represented by the formulae:

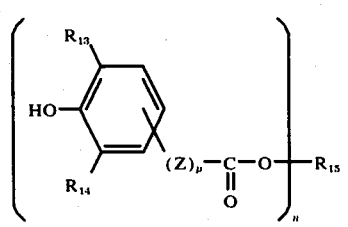

(IV)

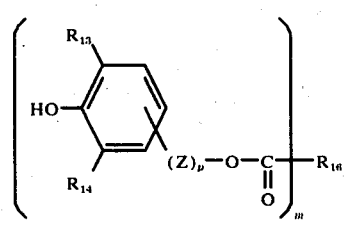

(V)

wherein Z is a di-valent group containing up to 30 carbon atoms, $R_{13}$ is an alkyl group having 1 to 20 carbon atoms, $R_{14}$ is a hydrogen atom or an alkyl group having 1 to 20 carbon atoms, $R_{15}$ is an alcohol residue, $R_{16}$ is a carboxylic acid residue, n and m each is a positive integer which is equal to number of alcohol and carboxylic acid residues, respectively, esterified, and p is 0 or 1. Specific examples of these compounds includes tetrakis[methylene-(3,5-di-tert-butyl-4-hydroxyhydrocinnamate)]methane and octadecyl-3-(3′,5′-di-tert-butyl-4′-hydroxyphenyl)propionate.

It has been found that, of these esters, those represented by the following general formula (VI) provide an increased image density and desirable black tone when used in combination with phthalazinones, which can be present in the composition according to the invention as a particularly desirable activator toning agent as described hereinafter.

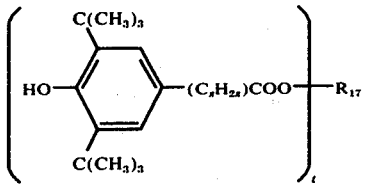

(VI)

wherein $R_{17}$ represents a residue of a saturated acyclic fatty alcohol represented by the formula $C_dH_{2d+2-t}$ wherein d represents a positive integer of from 1 to 6 and t represents a positive integer of from 1 to 4d, and s represents 1, 2, 3 or 4.

Further, photodecomposable reducing agents such as ascorbic acid and the derivatives thereof, furoin, benzoin, dihydroxyacetone, glyceraldehyde, rhodizonic acid tetrahydroxyquinone, 4-methoxy-1-naphthol, etc., are preferred. They are decomposed by light even if the light-sensitive materials in which they are present are allowed to stand in the light after development, whereby reduction does not proceed and so no color change occurs. Furthermore, direct positive images can be obtained by destroying the reducing agent upon imagewise exposure as disclosed in Japanese Pat Publications Nos. 22185/70 and 41865/71.

Two or more reducing agents can be used. Examples of the two or more reducing agents used in combination are disclosed in Japanese Pat. application No. 27242/73, U.S. Pat. Nos. 3,667,958 and 3,751,249. It has also been confirmed that the development can be accelerated by using the reducing agent in combination with a tin compound, an iron compound, a cobalt compound, or a nickel compound.

A suitable reducing agent used is selected based on the combination of the organic silver salt employed as the component (a) with which the reducing agent is used. For example, a strong reducing agent is suitable for a silver salt such as a silver salt of benzotriazole or silver behenate which is comparatively difficult to reduce, and a weak reducing agent is suitable for a silver salt such as silver caprate or silver laurate which is comparatively easy to reduce. That is, once the organic silver salt is determined, the reducing agent can be selected depending on the organic silver salt. Suitable reducing agents for silver benzotriazole are 1-phenyl-3-pyrazolidones, ascorbic acid, ascorbic acid monoesters and naphthols such as 4-methoxy-1-naphthols. Suitable reducing agents for silver behenate are o-bisphenols and hydroquinone. Suitable reducing agents for silver caprate and silver laurate are substituted tetrakisphenols, p-bisphenols such as substituted bisphenol A, and p-phenylphenol. The selection of an appropriate reducing agent for the organic silver salt can be facilitated by using two or more reducing agents.

The amount of the reducing agent used in the invention can widely vary depending on the kind of organic silver salt used, the kind of reducing agent used and the other additives present, but the amount of the reducing agent is generally about 0.05 to 5 mols, preferably about 0.1 to 2 mols per mol of the organic silver salt.

If desired, an auxiliary reducing agent can be used in combination with the reducing agent employed. The amount of the auxiliary reducing agent to be used in the invention can be varied over a wide range, depending on the reducing power of the reducing agents and the reducibility of the organic silver salt used, but a suitable amount of the auxiliary reducing agent generally is from about $10^{-5}$ to 1 mole, preferably from $10^{-3}$ to 0.8 mole per mole of the main reducing agent. Examples of effective combinations of reducing agents include a combination of o— or p— bisphenols and the above described esters selected from the group consisting of esters of mono— or polyhydric phenols or alcohols with carboxylic acids derived from phenols having at least one bulky ortho-substituent, and esters of mono— or poly-carboxylic acids with polyhydric phenols having at least one bulky ortho-substituent or alcohols derived from phenols having at least one bulky ortho-substituent. By use of this combination, a heat-developable light-sensitive element having reduced heat-fogging, increased whiteness and improved light stability after development can be obtained.

In forming a black image of silver using the heat developable light-sensitive material of the present invention, a color toning agent as an additive is preferably incorporated in the material. The color toning agent is used when it is desired to change the formed image into a deep color image and particularly into a black image. The amount of the color toning agent generally ranges from about 0.0001 mol to about 2 mols, and preferably about 0.0005 mol to about 1 mol, per mol of the organic silver salt. Although the color toning agent which is effective depends upon the organic silver salt and the reducing agent used, in general, heterocyclic organic compounds containing at least two hetero atoms wherein at least one nitrogen atom is present in the ring are used as a color toning agent. These compounds are described in, for example, U.S. Pat. No. 3,080,254. Phthalazone (phthalazinone), phthalic acid anhydride, 2-acetylphthalazinone, 2-phthaloylphthalazinone and substituted phthalazinone derivatives as described in West German Pat. application (OLS) No. 2,449,252 also can be suitably used in the present invention.

Examples of other effective color toning agents include pyrazolin-5-ones, cyclic imides and quinazolinone, as described in U.S. Pat. No. 3,846,136. For example, phthalimide, N-hydroxyphthalimide, N-potassium phthalimide and silver phthalimide are typical. Silver phthalazinone is also effective as a color toning agent. Other effective color toning agents are the mercapto compounds described in U.S. Pat. No. 3,832,186 and West German Pat. application (OLS) No. 2,321,217. In addition, the oxazinediones as described in West German Pat. application (OLS) No. 2,422,012, the phthalazine diones described in West German Pat. application (OLS) No. 2,449,252, the uracils described in Japanese Pat. application No. 18378/1974, the N-hydroxynaphthalimides described in U.S. Pat. No. 3,782,941, the substituted phthalimides described in West German Pat. application (OLS) Nos. 2,140,406, 2,141,063 and U.S. Pat. No. 3,844,797, and the phthalazinone derivatives described in West German Pat. application (OLS) No. 2,220,618 can be used too.

Preferably each component used in the present invention is included in a binder so as to provide a homogeneous film on a support. Although preferred binders are generally hydrophobic, hydrophilic binders can also be used. These binders are transparent or semitransparent. For example, proteins such as gelatin or gelatin derivatives, cellulose derivatives, polysaccharides such as dextran, natural materials such as gum arabic, latex vinyl compounds which increase the dimensional stability of the photographic materials and synthetic polymers described hereinafter can be used. Preferred synthetic polymers are those described in U.S. Pat. Nos. 3,142,586, 3,193,386, 3,062,674, 3,220,844, 3,287,289 and 3,411,911. Effective polymers include water-insoluble polymers of alkyl acrylates and methacrylates, acrylic acid, sulfoalkyl acrylates or methacrylates, and compounds having a repeating sulfobetaine unit as described in Canadian Pat. No. 774,054. Examples of preferred high molecular weight materials and resins include polyvinyl butyral, polyacrylamide, cellulose acetate butyrate, cellulose acetate propionate, polymethyl methacrylate, polyvinyl pyrrolidone, polystyrene, ethyl cellulose, polyvinyl chloride, chlorinated rubber, polyisobutylene, butadiene-styrene copolymers, vinyl chloridevinyl acetate copolymers, vinyl acetate-vinyl chloride-maleic acid-terpolymers, polyvinyl alcohol, polyvinyl acetate, benzyl cellulose, polyvinyl acetate, acetylcellulose, cellulose propionate and cellulose acetate phthalate, etc. Of these polymers, polyvinyl butyral, polyvinyl acetate ethyl cellulose, polymethyl methacrylate and cellulose acetate butyrate are more preferred. The most preferred material is polyvinyl butyral. If desired, two or more of these materials can be used as a mixture. The ratio by weight of the binder to the organic silver salt of component (a) generally ranges from about 10:1 to about 1:10 and preferably about 4:1 to about 1:4.

The layers containing each component described herein and other layers in the present invention can be applied to many kinds of supports. Examples of supports which can be used in the present invention are synthetic resin films such as cellulose nitrate films, cellulose ester films, polyvinyl acetal films, polyethylene films, polyethylene terephthalate films or polycarbonate films, etc., glass plates, paper and metal plates such as an aluminium plate, etc. Partially acetylated materials can also be used. Further, baryta paper, synthetic resin coated paper and water-resistant paper can be used as well. It is further preferred from the viewpoint of handling that the support is flexible. Art paper, coated paper and clay processed paper are preferred as paper supports. Paper which has been sized with a polysaccharide, etc., is also preferred. The organic silver salt and the silver halide are each used in the amount such that the sum total of silver amount of both coated on the support is about 0.2 g to about 3 g, preferably about 0.3g to about 2 g, per $m^2$ of the support. If the amount coated is below about 0.2 g, the image density is low. If the amount coated is above about 3 g, the cost is increased while no additional advantages in photographic properties are achieved.

Certain spectral sensitizing dyes which are known to be effective for gelatin-silver halide emulsions can be used for the heat-developable light-sensitive materials of the present invention in order to further increase the sensitivity. Effective spectral sensitizing dyes include cyanine, merocyanine, complex (trinuclear or tetranuclear) cyanine, holopolar cyanine, styryl, hemicyanine, oxonol and hemioxonol dyes. Of the cyanine dyes, those containing a basic nucleus such as a thiazoline, oxazoline, pyrroline, pyridine, oxazole, thiazole, selenazole, or imidazole ring are suitable. Further, such a nucleus can have an alkyl group, an alkylene group, a hydroxyalkyl group, a sulfoalkyl group, a carboxyalkyl group, an aminoalkyl group or an enamine group as a substituent or can form a condensed carbocyclic group or heterocyclic group. The cyanine dyes can be either symmetric or asymmetric. Further, the dyes can have an alkyl group, a phenyl group, an enamine group or a heterocyclic substituent on the methine chain or the polymethine chain thereof. Particularly, cyanine dyes containing a carboxyl group are effective for sensitization. The merocyanine dyes can contain an acid nucleus such as a thiohydantoin nucleus, a rhodanine nucleus, an oxazolidindione nucleus, a thiazolidindione nucleus, a barbituric acid nucleus, a pyrazolone nucleus or a malonitrile nucleus in addition to the above-described basic nucleus. These acid nuclei can be substituted with an alkyl group, an alkylene group, a phenyl group, a carboxyalkyl group, a sulfoalkyl group, a hydroxyalkyl group, an alkoxyalkyl group, an alkylamino group or a heterocyclic nucleus. Particularly, merocyanine dyes having an imino group or a carboxyl group are effective for sensitization. If desired, these dyes can be used as a combination of two or more thereof. Further, they can be used together with ascorbic acid derivatives, azaindenes, cadmium salts, organic sulfonic acids or supersensitizing additives which do not absorb visible light as described in, for example, U.S. Pat. Nos. 2,933,390 and 2,937,089, etc. Effective sensitizing dyes for the heat developable light-sensitive materials of the present invention include merocyanine dyes containing a rhodanine nucleus, a thiohydantoin nucleus or a 2-thio-2,4-oxazolidindione nucleus as described in U.S. Pat. No. 3,761,279, for example, 3-pcarboxyphenyl-5-[β-ethyl-2-(3-benzoxazolylidenyl)ethylidenyl]rhodanine, 5- 3-β-carboxyethyl-2-(3-thiazolinylidenyl)- ethylidenyl]-3-ethyl rhodanine, 3-carboxymethyl-5-[(3-methylthiazolinylidenyl)-α-ethylethylidenyl]rhodanine, 1-carboxymethyl5-[(3-ethyl-2-(3H)-benzoxazolylidenyl)ethylidenyl]-3-phenyl-2-thiohydantoin, 5-[(ethyl-2-benzoxazolylidenyl)-1-methylethylidenyl]-3-[(3-pyrrolin-1-yl)propyl]-rhodanine and 3-ethyl-5[)3-ethyl-2-(3H)-benzothiazolylidenyl)isopropylidenyl]-2-thio-2,4-oxazolidindione, etc. Trinuclear merocyanine dyes as described in U.S. Pat. No. 3,719,495, polynuclear aromatic dyes as described in Belgian Pat. No. 788,695, sensitizing dyes for silver iodide as described in West German Pat. application (OLS) No. 2,328,868, styrylquinoline dyes as described in West German Pat. application (OLS) No. 2,363,586, rhodacyanine dyes as described in West German Pat. application (OLS) No. 2,405,713, acid dyes such as 2',7'dichlorofluoroscein dyes as described in West German Pat. applications (OLS) Nos. 2,404,591, 2,401,982, and 2,422,337 and merocyanine dyes as described in Japanese Pat. application No. 10815/1974 are other examples of sensitizing dyes which can be similarly used in the present invention. Examples of effective merocyanine dyes which have pyrazolone nuclei are as follows:

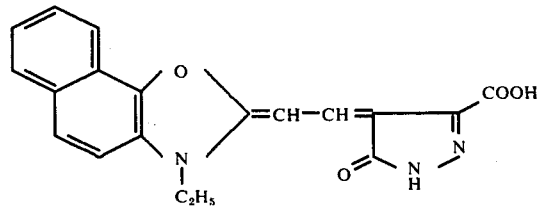

-continued

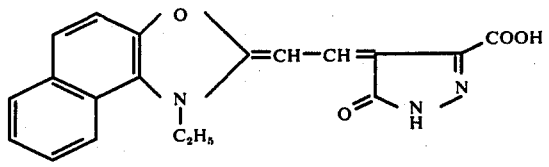

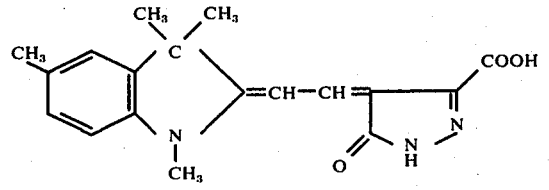

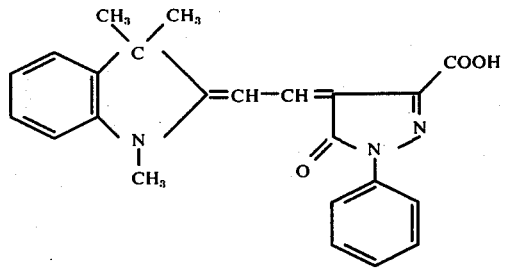

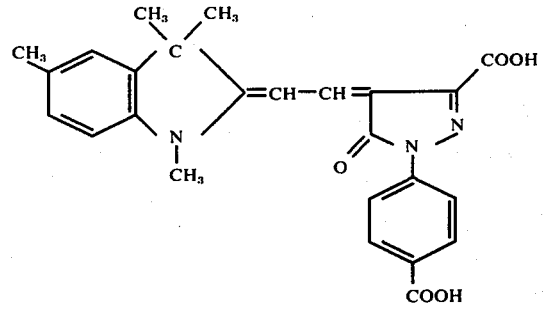

The amount of these dyes generally ranges from about $10^{-4}$ to about 1 mol per mol of the light-sensitive silver halide or the silver halide forming component.

The heat-developable light-sensitive materials used in the present invention can have an antistatic layer or an electrically conductive layer. These layers can contain soluble salts such as halides or nitrates, ionic polymers as described in U.S. Pat. Nos. 2,861,056 and 3,206,312 and insoluble inorganic salts as described in U.S. Pat. No. 3,428,451. Further, the heat-developable light-sensitive materials can have an evaporation-deposited metal layer. If desired, the heat-developable light-sensitive materials of the present invention can contain an antihalation material or an antihalation dye. Preferred examples of such dyes are those dyes which are decolored upon heat development. For example, the dyes described in U.S. Pat. Nos. 3,768,019, 3,745,009 and 3,615,432 are preferred. Further, filter dyes or light absorbing materials as described in U.S. Pat. Nos. 3,253,921, 2,527,583 and 2,956,879 can be incorporated into the heat-developable light-sensitive materials of this invention.

If desired, the heat-developable light-sensitive materials of the present invention can contain a matting agent such as starch, titanium dioxide, zinc oxide, silica, polymer beads such as those described in U.S. Pat. Nos. 2,922,101 and 2,761,245, kaolin or clay, etc. Furthermore, they can contain an optical whitening agent such as the stilbenes, triazines, oxazoles or coumarins as described in, for example, German Pat. Nos. 972,067 and 1,150,274, French Pat. No. 1,530,244 and U.S. Pat. Nos. 2,933,390 and 3,406,070. These optical whitening agents can be used as an aqueous solution or as a dispersion.

The heat-developable light-sensitive materials of the present invention can additionally contain a plasticizer and a lubricant. For example, glycerin, diols, polyhydric alcohols as described in U.S. Pat. No. 2,960,404, aliphatic acids or esters as described in U.S. Pat. Nos. 2,588,765 and 3,121,060 and silicone resins described in, for example, British Pat. No. 955,061 can be used as plasticizers and lubricants. Furthermore, the light-sensitive materials can contain a surface active agent, for example, saponin and alkylaryl sulfonates described in, for example, U.S. Pat. No. 2,600,831, ampholytic compounds described in, for example, U.S. Pat. No. 3,133,816 and addition products of glycidol and alkyl phenols described in, for example, British Pat. No. 1,022,878. Hardenable layers of the heat-developable light-sensitive layers used in the present invention can be hardened by organic or inorganic hardening agents. These hardening agents can be used individually or as a combination of two or more thereof. Preferred hardening agents are aldehydes, blocked aldehydes, ketones, carboxylic acids, carbonic acid derivatives, sulfonic acid esters, sulfonyl halides, vinyl sulfonyl esters, active halogen compounds, epoxy compounds, aziridines, active olefins, isocyanates, carbodiimides and polymeric hardening agents such as dialdehyde starch, etc. Further, many additives can be used for increasing the density of the resulting images. For example, non-aqueous polar organic solvents such as compounds having a

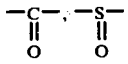

group as described in U.S. Pat. No. 3,667,959, for example, tetrahydrothiophene-1,1-dioxide, 4-hydroxybutanoic acid lactone and methylsulfinyl methane are effective. Zinc, cadmium and copper acetates as described in U.S. Pat. No. 3,708,304 are also effective. Furthermore, compounds containing water of crystallization as described in U.S. Pat. No. 3,635,719, acid salts of amines and compounds which become alkaline on heating such as metal oxides or hydroxides are effective as the materials for accelerating development. It is possible to use polyalkylene glycols together with mercaptotetrazole in order to improve the sensitivity, contrast and image density as described in U.S. Pat. No. 3,666,477.

Various methods can be utilized in order to prevent the generation of heat fog of the heat-developable light-sensitive materials of the present invention. One method comprises using mercury compounds, as described in U.S. Pat. No. 3,589,903. Further, it is possible to form direct positive images using mercury compounds as described in U.S. Pat. No. 3,589,901. Furthermore, the mercury compounds can be used together with color forming couplers in order to form stabilized color images as described in U.S. Pat. No. 3,764,328. A second method for preventing the generation of heat fog is described in West German Pat. (OLS) Nos. 2,326,865, 2,402,161, 2,364,630, wherein N-halo compounds such as N-halosuccinimides or N-haloacetamides are used. Other methods for preventing the generation of heat fog are described in U.S. Pat. No. 3,645,739, West German Pat. application (OLS) No. 2,445,038, and Japanese Pat. applications (OPI) Nos. 89,720/1973 and 125016/1074, wherein higher aliphatic acids such as lauric acid, myristic acid, palmitic acid, stearic acid or behenic acid, etc., tetrahalophthalic acid or the anhydride thereof, aryl sulfonic acids such as benzene sulfonic acid or p-toluene sulfonic acid, aryl sulfinic acid or salts thereof such as benzene sulfinic acid or p-toluene sulfinic acid, and lithium salts of higher aliphatic acids such as lithium stearate, etc., are used as acid stabilizing agents. Other effective acid stabilizing agents include salicylic acid, p-hydroxybenzoic acid, tetrabromobenzoic acid, tetrachlorobenzoic acid, p-acetamidobenzoic acid, alkyl substituted benzoic acids such as p-t-butylbenzoic acid, phthalic acid, isophthalic acid, trimellitic acid, pyromellitic acid, diphenic acid, and 5',5'-methylene-bis-salicyclic acid. These acid stabilizing agents not only prevent the generation of heat fog but also sometimes have the functions of preventing discoloration when exposed to white light, increasing the image density or improving the shelf life (the property that the photographic properties of the light-sensitive material possessed just after production are maintained after storage). Other compounds which are effective for preventing generation of heat fog are benzotriazole and derivatives thereof, thiouracils, for example, 2-thiouracils represented by the formula (VII):

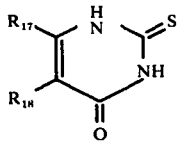

(VII)

wherein $R_{17}$ represents a hydrogen atom; a hydroxyl group, an alkoxy group, a halogen atom, an unsubstituted or substituted lower alkyl group, a benzyl group, an allyl group, an amino group, a nitro group or a nitroso group, and $R_{18}$ represents a hydrogen atom, a hydroxyl group, a halogen atom, an amino group, an acetamido group, an unsubstituted or substituted alkyl group having 1 to 22 carbon atoms, an aryl group, such as a phenyl group, or a substituted aryl group, mercapto compounds such as 1-phenyl-5-mercaptotetrazole, azole thioethers or blocked azolethiones, and peroxides or persulfates as described in Japanese Pat. application No. 5453/1974. Also, effective prevention of the generation of heat fog or improvement in photographic properties such as sensitization can be achieved if chromium salts, rhodium salts, copper salts, nickel salts, cobalt salts and complex salts of rhodium, iron or cobalt are present during formation or before formation of the silver halide.

In order to prevent discoloration by light of the processed light-sensitive material (the phenomenon in which the unexposed area of the light-sensitive material after processing is discolored gradually by light when exposed to normal room illumination), it is possible to use stabilizer precursors such as azole thioethers or blocked azolethiones as described in U.S. Pat. No. 3,839,049, tetrazolyl thio compounds as described in U.S. Pat. No. 3,700,457 and light-sensitive halogen-containing organic oxidizing agents as described in U.S. Pat. No. 3,707,377.

In addition, it is possible to use light-absorbing dyes as described in British Pat. No. 1,261,102, for, particularly, transmission light-sensitive materials in order to improve the resolving power. Further, it is possible to use leuco dye compounds described in, for example, West German Pat. application (OLS) No. 2,446,892 in order to improve the shelf life. It is also possible to increase the whiteness by blueing the elements using blue dyes such as Victoria Blue so that the color stain of dyes can be reduced, as described in Japanese Pat. Application No. 22135/1974.

Further, it is possible in some cases to stabilize the processed light-sensitive materials to light or heat. Effective methods include the process described in U.S. Pat. No. 3,617,289 which comprises stabilizing the materials using a solution containing mercapto compounds and the method described in West German Pat. application (OLS) No. 2,443,292 which comprises providing a laminate containing a stabilizing agent.

Further, it is possible to provide, if desired, a topcoating polymer layer on the light-sensitive layer in order to enhance the transparency of the heat developable light-sensitive layer, to increase the image density and to improve the shelf life, as described in West German Pat. application (OLS) No. 2,323,452. A preferred thickness for the top coating polymer layer ranges from about 1 micron to about 20 microns. Examples of polymers suitable for the top-coat polymer layer include polyvinyl chloride, polyvinyl acetate, vinyl acetate-vinyl chloride copolymers, polystyrene, polymethyl methacrylate, methyl cellulose, ethyl cellulose, cellulose acetate butyrate, cellulose acetate, polyvinylidene chloride, cellulose propionate, cellulose acetate phthalate, polycarbonate, cellulose acetate propionate and polyvinyl pyrrolidone, etc. A top coat polymer layer containing a material such as kaolin, silica or a polysaccharide such as starch therein, as described in Belgian Pat. No. 798,367 and Japanese Pat. application (OPI) No. 46316/1975 provides the heat developable light-sensitive material with the ability to be written upon with a ball-point pen or a pencil. Further, the top coat polymer layer can contain a filter dye, an ultraviolet light absorbing agent or an acid stabilizing agent such as higher aliphatic acids, etc.

The heat-developable light-sensitive layers, the top-coat polymer lapyer, a subbing layer, a back layer and other layers used in the present invention can be coated on a support using various coating methods. Examples of such methods are a dip-coating method, an air-knife coating method, a curtain coating method and a hopper coating method. If desired, two or more layers can be coated at the same time using the methods described in U.S. Pat. No. 2,761,791 and British Pat. No. 837,095.

The heat-developable light-sensitive materials as in the present invention generally have the characteristic that the photographic properties thereof are easily deteriorated by moisture. Therefore, when the prepared light-sensitive materials are packed and sent into the trade as commodities, a drying agent, as described in West German Pat. application (OLS) No. 2,422,040, is generally packed with the materials.

The heat-developable light-sensitive materials of the present invention can have a subbing layer between the support and the heat-developable light-sensitive layer. Examples of binders which can be used for such a subbing layer include various polymers as described hereinbefore. For example, polyvinyl butyral, polyacrylamide, cellulose acetate butyrate, cellulose acetate propionate, polymethyl methacrylate, polystyrene, polyvinyl pyrrolidone, ethyl cellulose, polyvinyl chloride, chlorinated rubber, polyisobutylene, butadiene-styrene copolymers, vinyl chloride-vinyl acetate copolymers, vinyl acetate-vinyl chloride-maleic acid terpolymers, polyvinyl alcohol, polyvinyl acetate, cellulose acetate, cellulose propionate, cellulose acetate phthalate, gelatin, gelatin derivatives and polysaccharides, etc., can be used. It is possible to improve the photographic properties such as light-discoloration or heat fog, etc., by incorporating aliphatic acids or metal salts thereof in the subbing polymer layer. Further, it is possible to prevent permeation of solvents by incorporating pigments such as clay into the subbing layer. In addition, a matting agent such as silica, kaolin, titanium dioxide or zinc oxide can be added to the subbing layers. Further, a nonelectrolytic deposition layer composed of a conductive metal as described in U.S. Pat. No. 3,748,137 can be present. It is also possible to improve the moisture resistance or to prevent curling in case of a paper support by providing a hydrophobic polymer layer on the back of the support.

The heat-developable light-sensitive materials of the present invention are cut to appropriate sizes and are developed by heating after image exposure.

The light-sensitive materials of the invention can be preheated before exposure to light as described above (to about 80° C to 140° C). Light sources suitable for image exposure are tungsten lamps, fluorescent lamps used for exposing diazotype light-sensitive materials, mercury lamps, xenon lamps, cathode ray tube (CRT) light sources and laser light sources, etc. As originals, not only line images such as drawings but also photographic images having a gradation can be used. Further, it is possible to directly photograph people and landscapes using a camera. The light-sensitive materials can be printed by direct contact of the light-sensitive material with the original, or can be printed using a reflection printing method or using an enlarged printing method. Although exposure depends upon the sensitivity of the light-sensitive materials, an exposure of about 10 luxes second is required for high speed sensitive materials and an exposure of about $10^4$ luxes second is required for low speed sensitive materials. The thus image-exposed light-sensitive materials can be developed simply by heating (e.g., to about 80° C to about 180° C, preferably about 100° C to about 150° C). The heating time can be suitably, for example, about 1 second to 60 seconds. The heating time, of course, is related to the heating temperature employed. In general, a suitable heating time is about 5 seconds to about 40 seconds at 120° C, about 2 seconds to about 20 seconds at 130° C and about 1 second to about 10 seconds at 140° C.

Various means can be used for heating. For example, the light-sensitive material can be contacted with a simple heated plate or with a heated drum or, if desired, it can be passed through a heated space. Further, the heating can be carried out by high frequency heating or by laser beams. In order to prevent a bad odor from being emitted on heating, the processing devices can be equipped with a deodorizer. It is also possible to incorporate certain perfumes so as to mask any bad odor of the light-sensitive materials which might be formed.

The preparation of heat-developable light-sensitive materials of the invention will be illustrated by reference to the following examples and is briefly explained as follows.

An organic silver salt-forming agent is reacted with a silver ion-providing agent (e.g., silver nitrate) using one of the various methods described above to form an organic silver salt. The preparation conditions are at atmospheric pressure and a temperature of about −15° C to 80° C, preferably about 20° to 60° C. After washing the prepared organic silver salt with water or an alcohol, the salt is dispersed in a binder for an emulsion using a colloid mill, a mixer or a ball mill at normal temperature (e.g., about 15° to 25° C). To the polymer dispersion of the silver salt, a silver halide-forming agent is added to convert a part of the organic silver salt to silver halide. In this case, the reaction temperature ranges from about normal temperature to about 80° C, and the reaction time is about 1 minute up to about 48 hours. Further, a previously prepared silver halide as described above can be added, or silver halide can be simultaneously prepared along with the organic silver salt. Then, any additives such as spectral sensitizing dyes, reducing agents or toning agents are added, preferably as solutions thereof. These solutions are usually added at suitable intervals (e.g., about 5 to 20 minutes) to the system with stirring at about normal temperature to 50° C. When all additives have been added, the coating composition is then coated on a suitable support using a coating apparatus. The temperature of the coating ranges from about 5° to 50° C. The drying temperature of the coated layers is about 3° to 100° C and the coating speed is about 3 to 150 meter/min. If desired, the overcoating polymer layer, the subbing layer and the backing layer can be coated under similar conditions. Also, these additional layers can be simultaneously coated.

The heat-developable light-sensitive materials of the invention have little heat fog and the processed materials have improved light-stability.

The invention will be illustrated in greater detail by reference to the following Examples. Unless otherwise indicated herein, all parts percents, ratios and the like are by weight.

EXAMPLE 1

To 100 ml of benzene warmed to 60° C was added 3.4 g of behenic acid and the temperature of the resulting solution was controlled to 60° C. To this solution was added 100 ml of water with stirring to produce an emulsion. To about 80 ml of an aqueous solution containing 1.7 g of silver nitrate was added aqueous ammonium to produce a silver ammine complex and the total volume of this solution was made 100 ml by adding water. After cooling to 10° C, this solution was added to the emulsion prepared above to provide crystals of silver behenate. The reaction mixture was allowed to stand at room temperature (25° C). After 20 minutes the mixture had separated into a water layer and a benzene layer. The water layer was removed and the benzene layer was washed with 400 ml of water by decantation. To the resulting mixture was added 400 ml of methanol and then the silver behenate was collected by centrifugation. Four grams of spindle-shaped silver behenate having a major axis of about 1 $\mu$ and a minor axis of 0.05 $\mu$ was obtained. To 20 ml of an ethanol solution of polyvinyl butyral (2.5 g) was dispersed 2.3 g (about 0.005 mole) of silver behenate obtained above and to the resulting polymer dispersion of the silver salt, the following components at 30° were added, in succession at intervals of 5 minutes to prepare a coating composition.

| | | |
|---|---|---|
| (1) | Ammonium Bromide (silver halide-forming component) (2.5% by weight in methanol) | 1.5 ml |
| (2) | Merocyanine Sensitizing Dye* (0.025% by weight in methyl Cellosolve) | 2 ml |
| (3) | 2,2'-Methylenebis(6-t-butyl-4-methylphenol) (reducing agent) (25% by weight in acetone) | 4 ml |
| (4) | Phthalazone (toning agent) (2.5% by weight in methyl Cellosolve) | 3 ml |
| (5) | N-Chloro-2-oxazolinone (1% by weight in acetone) | 1 ml |

*

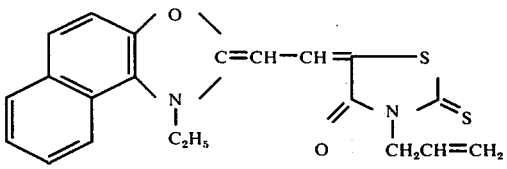

The thus prepared coating composition was coated on an art paper as a support at a silver coverage of about 1 g per m² to produce a heat-developable light-sensitive element, Sample A.

Two control samples were prepared in a similar manner as above, except that the above component (5) was not used or equimolar amount of N-chlorosuccinimide was used in place of the above component (5), each of which control samples is designated Sample B-1 and Sample B-2, respectively.

These samples were image-wise exposed through a negative having gradation to tungsten light (exposure quantity: 30,000 lux.sec) and developed by heating for 40 seconds at 120° C. The density was determined at the unexposed area ($D_{min}$) and at the fully exposed area ($D_{max}$). The samples were exposed to room light of an illumination strength of 800 lux for 6 hours, and the increase in density in the unexposed area (photodiscoloration) was determined. The results obtained are shown in Table 1.

Table 1

| Sample | $D_{max}$ | $D_{min}$* | Photodiscoloration |
|---|---|---|---|
| A | 1.25 | 0.15 | 0.03 |
| B - 1 (Control) | 1.30 | 1.20 | 0.10 |
| B - 2 (Control) | 1.26 | 0.25 | 0.06 |

*Heat fog

The results in Table 1 show that Sample A according to the invention was superior in heat fogging and light stability to the control samples.

Similar results were obtained in cases where:

1. toluene, xylene, benzyl acetate, isoamyl acetate and the like were used in place of the benzene in the formation silver behenate;

2. methanol, propanol, isopropanol and the like were used in place of ethanol to produce the polymer dispersion of the silver salt;

3. equimolar amounts of inorganic halides such as hydrogen bromide, sodium bromide, potassium bromide, calcium bromide, antimony bromide and the like were used in place of the ammonium bromide, component (1), in the coating composition;

4. other light sources such as a mercury lamp, a xenon lamp, a fluorescent lamp, CRT and laser light sources, and the like were used at the same quantity of exposure instead of a tungsten lamp; and 5. the heat development was carried out for 15 seconds at 130° C.

EXAMPLE 2

A solution of 1.9 g of sodium hydroxide in 100 ml of water and a solution of 12 g of lauric acid in 100 ml of toluene were prepared, the temperature was adjusted to 25° C, and the two solutions were emulsified by mixing the solutions in a separatory funnel. To this emulsion was added a solution of 8.5 g of silver nitrate, and the reslting mixture was allowed to stand. After 5 minutes the mixture had separated into a water phase and a toluene phase containing silver laurate. After the removal of the water phase, 200 ml of ethanol was added to the toluene phase, and the silver laurate was collected by centrifugation. Twelve grams of spindle-shaped crystals of silver laurate having a major axis of about 3 μ was obtained.

Into 70 g of ethyl alcohol were dispersed 6 g (about 1/50 mole) of silver laurate obtained about and 12 g of polyvinyl butyral. To this silver salt-polymer dispersion was added 0.05 g of N-bromosuccinimide at a temperature of 50° C with stirring and the dispersion was heated for 90 minutes.

To the resulting polymer dispersion the following components were added, in succession, at intervals of 5 minutes at 30° C.

| | | |
|---|---|---|
| (1) | Sensitizing Dye* (0.025% by weight in methyl Cellosolve) | 10 ml |
| (2) | Lauric Acid (acid stabilizer) (3% by weight in methyl Cellosolve) | 40 ml |
| (3) | Phthalazone (toning agent) (3% by weight in methanol) | 55 ml |
| (4) | 2,2-bis(3,5-Dimethyl-4-hydroxydiphenyl)-propane (reducing agent) (20% by weight in acetone) | 35 ml |
| (5) | 2-Oxazolinone (0.1% by weight in acetone) | 3 ml |

*

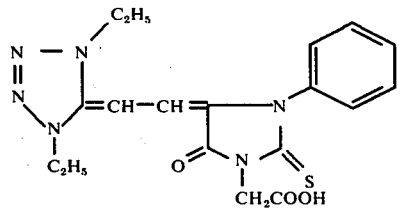

The thus-prepared coating composition was coated on an art paper as a support at a silver coverage of 0.3 g/m² or on a polyethylene terephthalate film as a support at a silver coverage of 1.7 g/m², and dried. The sample in which the art paper was employed is designated Sample C and the sample in which the polyethylene terephthalate film is employed is designated as Sample C'.

Onto the coated layer of Sample C was coated a dispersion of silica in a 10%, by weight, ethanol solution of ethyl cellulose (silica:ethyl cellulose= 1:10) to produce an overcoated polymeric layer having an thickness of about 1.5 μ, and onto the coated layer of Sample C' was coated a 15%, by weight, solution of a copolymer of vinyl chloride and vinyl acetate (monomer weight ratio: 85:15) in tetrahydrofuran to produce an overcoated polymeric layer having an thickness of about 3 μ.

Control Samples D and D′ were prepared in a similar manner as above, except that component (5) of the invention was not used, and comparison Samples E and E′ were prepared in a similar manner as above, except that known N-bromosuccinimide was used in place of component (5) of the invention.

The thus-prepared samples were image-wise exposed to tungsten light (quantity exposure: 3,000 lux) through a negative having gradation and developed by heating for 30 sec at 120° C. The reflection density was determined for the samples having a paper support, the transmission density was determined for the samples having a film support, and the photodiscoloration was determined as in Example 1. The results obtained are shown in Table 2.

Table 2

| Sample | Support | $D_{max}$ | $D_{min}$ | Photodiscoloration |
|---|---|---|---|---|
| C | Paper | 1.40 | 0.18 | 0.05 |
| D (Control) | " | 1.45 | 1.25 | 0.15 |
| E (Control) | " | 1.42 | 0.21 | 0.07 |
| C′ | Film | 3.30 | 0.09 | 0.02 |
| D′ (Control) | " | 3.40 | 1.85 | 0.08 |
| E′ (Control) | " | 3.35 | 0.12 | 0.03 |

Table 2 shows that the component according to the invention is highly effective for reducing both heat fogging and photodiscoloration of the heat-developable light-sensitive elements.

EXAMPLE 3

A solution of 0.8 g of cetyl ethyl dimethyl ammonium bromide in 100 ml of water was mixed with 100 ml of toluene. To this was added a solution of 0.425 g of silver nitrate in 10 ml of water to prepare silver bromide. The silver bromide was emulsified. To the resulting emulsion were added an emulsion prepared by mixing a solution of 12 g of lauric acid in 100 ml of toluene with a solution of 1.9 g of sodium hydroxide in 100 ml of water, and a solution of 8.5 g of silver nitrate in 50 ml of water to produce a mixture in which silver bromide and silver laurate were in contact with each other.

The resulting mixture was collected by centrifugation and dispersed into a solution of 30 g of polyvinyl acetal in 200 ml of ethanol using a mixer. To this silver salt-polymer dispersion the following components were added, in succession, at intervals of 5 minutes. During this procedure the temperature of the dispersion as maintained at 35° C.

| | | |
|---|---|---|
| (1) | 2,2-bis(3-Methyl-4-hydroxyphenyl)propane and 2,2-bis(3,5-Dimethyl-4-hydroxyphenyl)-propane (20% by weight acetone solution 1:1 by weight ratio of reducing agents) | 80 ml |
| (2) | 4-Methyl-N-bromo-2-oxazolinone (0.5% by weight in acetone) | 2 ml |

The thus prepared coating solution was coated on an art paper as a support at a silver coverage of 0.5 g/m². Onto this light-sensitive layer was coated a dispersion containing 1.5%, by weight, of kaolin and 10%, by weight, of cellulose diacetate in acetone to produce an overcoated polymer layer having a thickness of 1.5 μ. This heat-developable light-sensitive element is designated Sample F.

A control sample was prepared in a similar manner as above, except that Component (2), according to the invention, was not used.

These samples were exposed and developed as in Example 1. The results obtained demonstrated that Component (2), according to the invention, contributed to a reduction in heat fogging and photodiscoloration after processing.

Similar results were obtained in cases where:

1. benzene or xylene was employed in place of the toluene in the step of silver bromide formation;
2. silver chloride, silver chlorobromide or silver chloroiodobromide was used in place of the silver bromide;
3. silver salts of other fatty acids such as silver myristate, silver palmitate and the like were used in place of the silver laurate; and
4. silica was used in the same amount instead of kaolin in the overcoated polymer layer.

Into a solution of 8.6 g of capric acid in 100 ml of butyl acetate was emulsified 20 ml of a 2.5%, by weight, aqueous solution of hydrogen bromide while stirring with a stirrer at 5° C. To this emulsion was added 50 ml of an aqueous silver ammine complex solution containing 8.5 g of silver nitrate (which solution had been previously cooled to 5° C) over a period of 30 seconds to allow the capric acid, the hydrogen bromide and the silver ion to react simultaneously to form silver caprate and silver bromide simultaneously. After being allowed to stand, the mixture separated into a water phase and butyl acetate phase containing silver bromide and silver caprate. The water phase was removed and the butyl acetate phase was dispersed into 120 g of a 15%, by weight, solution of polyvinyl butyral in isopropanol. To the resulting silver salt-polymer dispersion, the following components were added in succession at 40° C at intervals of 5 minutes.

| | | |
|---|---|---|
| (1) | Myristic Acid (acid stabilizer (3% by weight in methanol) | 40 ml |
| (2) | Tetrachlorotetrabromofluorescein (sensitizing dye (0.25% by weight in methanol) | 60 ml |
| (3) | Phthalazone (toning agent (2.5% by weight in methyl Cellosolve) | 20 ml |
| (4) | Bisphenol A (reducing agent) (70% by weight) in methyl Cellosolve | 70 ml |
| (5) | 5-Phenyl-N-bromo-2-oxazolinone (0.1% by weight in acetone) | 10 ml |

The thus-prepared coating solution was coated on an art paper support at a silver coverage of 0.6 g/m². Onto this layer was coated a dispersion containing 1.5%, by weight, of kaolin and 10%, by weight, of cellulose diacetate in acetone to produce an overcoated polymer layer having a thickness of 1.5 μ. This heat developable light-sensitive element is designated Sample H.

A control sample, Sample I, was prepared in a similar manner as above, except that Component (5), according to the invention, was not used.

The samples were treated as in the preceding examples. Sample I had a marked degree of heat fogging, whereas Sample H had reduced heat fogging and was stable against light after processing. It can be concluded from these results that the component according to the invention is very effective for the prevention of heat fogging and for the reduction in photodiscoloration after processing.

Similar results were obtained where other organic acids such as lauric acid, palmitic acid, stearic acid, behenic acid and the like were used in place of myristic acid.

EXAMPLE 5

Into 100 ml of isoamyl acetate was dissolved 6 g of benzotriazole at 50° C and cooled to −15° C. Into 100 ml of a dilute nitric acid aqueous solution with a pH of 2.0 (25° C) was dissolved 8.5 g of silver nitrate and cooled to 3° C. This silver nitrate solution was added to the above benzotriazole solution with stirring while maintaining the temperature of the benzotriazole solution at −15° C to produce a dispersion containing silver benzotriazole crystals. After being allowed to stand, the dispersion separated into a water phase and an organic phase. The water phase was removed and then the organic phase was washed with 400ml of water by decantation. Additional 400 ml of water was added and silver benzotriazole was collected by centrifugation. Eight grams of silver benzotriazole crystals having a major axis of about 1 $\mu$ was obtained. To a solution of 4 g of ethyl cellulose in 40 ml of methyl ethyl ketone was added 2.5 g of silver benzotriazole obtained above and dispersed in a ball mill for 1 hour to prepare a polymer dispersion of the silver salt. To the resulting dispersion, the following components were added, in succession, at 50° C at intervals of 10 minutes to prepare a coating solution.

| | | |
|---|---|---|
| (1) | Cadmium Iodide (silver halide-forming component) (8.5% by weight in methanol) | 1.5 ml |
| (2) | Hexachlororhodium (III) Ammonium (hardening and antifogging agent) (0.1% by weight in water) | 3 ml |
| (3) | Ascorbic Acid Monopalmitate and Ascorbic Acid Dipalmitate (2 g each in methyl Cellosolve) | 10 ml |
| (4) | N-Ethyl-N'-dodecylurea (development promoter) (2.5% by weight in methyl Cellosolve) | 2 ml |
| (5) | Sensitizing Dye* (0.015% by weight in methyl Cellosolve) | 2 ml |
| (6) | 4-Benzyl-N-bromo-2-oxazolinone (0.1% by weight in acetone) | 1 ml |

*

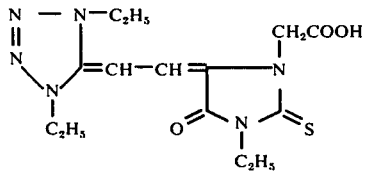

The thus prepared coating solution was coated on a coated paper as a support at a silver coverage of 1.0 g/m$^2$ to produce a heat-developable light-sensitive element. This element is designated Sample J.

A control sample, Sample K, was prepared in a similar manner as above, except that the above Component (6) was not used.

Samples J and K were exposed and developed as in Example 1, and their photographic properties were determined. Sample K was inferior in photodiscoloration and, in particular, heat fogging to Sample J according to the invention. It is apparent from these results that the oxazolone compound of the invention has marked effects.

While the invention has been described in detail and with reference to specific embodiments thereof, it will be apparent to one skilled in the art that various changes and modifications can be made therein without departing from the spirit and scope thereof.

What is claimed is:

1. A heat developable light-sensitive element comprising a support having therein or in at least one layer thereon (a) an organic silver salt, (b) a light-sensitive silver halide or a compound capable of forming a light-sensitive silver halide upon reaction with the organic silver salt, (c) a reducing agent and (d) an oxazolinone compound represented by the following general formula (I):

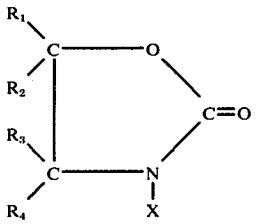

(I)

wherein $R_1$, $R_2$, $R_3$ and $R_4$ each is a hydrogen atom; an alkyl group having 1 to 22 carbon atoms; a haloalkyl group having 1 to 22 carbon atoms; an amino group; a hydroxyalkyl group having 1 to 22 carbon atoms; an allyl group; a naphthyl group; a benzyl group; a

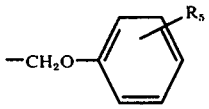

group in which $R_5$ is a hydrogen atom, a halogen atom, an alkyl group, an alkylthio group, an amino group or an alkylamino group; a benzyloxy group; an aryl group; a haloaryl group; an alkylaryl group; an alkoxyaryl group; an $-OR_6$ group in which $R_6$ is hydrogen atom, an alkyl group, an allyl group, an aryl group or an alkoxyaryl group; a

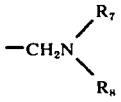

group in which $R_7$ and $R_8$ each is a hydrogen atom, an alkyl group, an aryl group or an allyl group; a cyclohexyl group; a $-CH_2OR_9$ group in which $R_9$ is a naphthyl group; or a $-CH_2R_{10}$ in which $R_{10}$ is a morpholino group, a piperadino group or an alkylthio group; and X is a hydrogen atom, a chlorine atom or a bromine atom.

2. The heat-developable light-sensitive material of claim 1, wherein said organic silver salt is a silver salt of an organic compound containing an imino group, a mercapto group, a thione group or a carboxyl group.

3. The heat-developable light-sensitive material of claim 2, wherein said organic silver salt is an organic silver carboxylate.

4. The heat-developable light-sensitive material of claim 3, wherein said organic silver salt is a silver salt of an aliphatic long chain fatty acid.

5. The heat-developable light-sensitive material of claim 1, wherein said reducing agent is a substituted phenol, an unsubstituted or substituted bisphenol, an unsubstituted or substituted bisnaphthol, a di- or polyhydroxybenzene, a di- or polyhydroxynaphthalene, a hydroquinone monoether, ascorbic acid or a derivative thereof, a 3-pyrazolidone, a pyrazolin-5-one, a reducing saccharide, a p-phenylenediamine or a derivative thereof, a reductone, kojic acid, hinokitiol, a hydroxylamine, a hydroxytetronic acid, a hydroxytetronamide, a hydroxyoxamic acid, a sulfohydrooxamic acid, a hydrazide, an indan-1,3-dione, a p-oxyphenylglycine, an ester of a carboxylic acid derived from a phenol having a bulky substituent in at least one orthoposition with a monohydric or polyhydric alcohol or phenol, or an ester of an alcohol derived from a phenol having a bulky substitutent in at least one ortho-position or a phenol having a bulky substituent in at least one ortho-position with a mono- or polycarboxylic acid.

6. The heat-developable light-sensitive material of claim 1, wherein the compound represented by the formula (I) is present in an amount of about 0.001 to 0.5 mol per mol of the organic silver salt.

* * * * *